US005928060A

United States Patent [19]

Miller

[11] Patent Number: 5,928,060

[45] Date of Patent: Jul. 27, 1999

[54] PROCESS FOR GRINDING EDGES OF A GLASS SHEET

[75] Inventor: Mark A. Miller, Independence, Ky.

[73] Assignees: Mark A. Miller, Independence; Bernard A. Fassler, Ft. Thomas, both of Ky.; Louis H. Lauch, Jr., Cincinnati, Ohio

[21] Appl. No.: 08/901,817

[22] Filed: Jul. 28, 1997

Related U.S. Application Data

[62] Division of application No. 08/649,459, May 17, 1996, Pat. No. 5,713,784.

[51] Int. Cl.[6] ..... B24B 49/02

[52] U.S. Cl. ..... 451/5; 451/11; 451/44; 451/58

[58] Field of Search ..... 451/5, 10, 11, 451/14, 41, 43, 44, 58, 218, 246, 394

[56] References Cited

U.S. PATENT DOCUMENTS

| | | | |
|---|---|---|---|
| 4,286,415 | 9/1981 | Loreto | 451/44 X |
| 4,406,091 | 9/1983 | Eckardt et al. | 451/44 X |
| 4,426,811 | 1/1984 | Eckardt et al. | 451/44 X |
| 4,524,547 | 6/1985 | Heaston et al. | 451/44 X |
| 4,528,780 | 7/1985 | Halberschmidt et al. | 451/44 X |
| 4,587,764 | 5/1986 | Leone et al. | 451/44 X |
| 4,667,444 | 5/1987 | Langlois et al. | 451/44 X |
| 4,769,954 | 9/1988 | Hatas et al. | 451/44 X |
| 4,793,101 | 12/1988 | Dlouhy et al. | 451/44 |
| 4,829,715 | 5/1989 | Langlois et al. | 451/43 X |
| 4,864,779 | 9/1989 | Ozaki | 451/44 X |
| 4,908,996 | 3/1990 | Friedman et al. | 451/43 |
| 4,928,439 | 5/1990 | Ramos et al. | 451/43 X |
| 5,040,342 | 8/1991 | McGuire et al. . | |
| 5,056,270 | 10/1991 | Curcher | 451/43 |
| 5,079,876 | 1/1992 | Zumstein | 451/43 |
| 5,146,715 | 9/1992 | Bando | 451/43 |
| 5,161,333 | 11/1992 | Lecerf et al. | 451/43 X |
| 5,185,959 | 2/1993 | Ikola et al. | 451/43 X |
| 5,197,229 | 3/1993 | Kanamaru et al. | 451/43 X |
| 5,216,844 | 6/1993 | Tamburini et al. | 451/43 X |
| 5,410,843 | 5/1995 | Gottschald | 451/58 X |
| 5,445,554 | 8/1995 | Hosokawa | 451/44 X |
| 5,514,025 | 5/1996 | Hasegawa et al. | 451/44 |
| 5,549,503 | 8/1996 | Nauche et al. | 451/43 X |
| 5,658,189 | 8/1997 | Kagamida | 451/44 X |
| 5,713,784 | 2/1998 | Miller | 451/44 X |
| 5,727,990 | 3/1998 | Hasegawa et al. | 451/44 |
| 5,738,563 | 4/1998 | Shibata | 451/44 X |

FOREIGN PATENT DOCUMENTS

| | | |
|---|---|---|
| 3534425 | 8/1986 | Germany . |
| 3705886 | 9/1988 | Germany . |
| 6-39696 | 2/1994 | Japan . |

OTHER PUBLICATIONS

Glassline, "Big Performance on Small Parts!" Sales Brochure for Model D600S CNC Grinder.

*Primary Examiner*—Timothy V. Eley
*Attorney, Agent, or Firm*—Wood, Herron & Evans, L.L.P.

[57] ABSTRACT

This invention provides a clean and inexpensive apparatus and method of rapidly grinding an edge of a sheet of glass. The method involves: locating a sheet of glass on a support surface, lifting a sheet by a rotatable support which is movable through two axes, lifting the sheet by a rotatable support, moving the sheet along the first axis to a predetermined height, moving the sheet along the second axis until the sheet makes contact with the grinding wheel, translating the sheet to maintain contact with the grinding wheel while the glass is rotated, and replacing the glass on a support surface after the entire periphery of the glass is ground. Also disclosed is an apparatus for performing this method.

3 Claims, 14 Drawing Sheets

PROCESS FOR GRINDING EDGES OF A GLASS SHEET

This is a division, of application Ser. No. 08/649,459, filed May 17, 1996 now U.S. Pat. No. 5,713,784.

REFERENCE TO MICROFICHE APPENDIX

A microfiche appendix is attached to this application (One microfiche and 56 frames). The software in this appendix is subject to copyright protection. The copyright owner has no objection to the copying of the appendix in the form it appears in the files of the U.S. Patent and Trademark Office, but reserves all other rights under copyright law.

BACKGROUND OF THE INVENTION

Processes of grinding the edges of glass sheets are known. Relevant patents regarding grinding of the edges of glass sheets include U.S. Pat. Nos. 4,769,954, 4,528,780, 4,426,811, 4,406,091, 5,126,844, 5,197,229, 5,185,959, 5,040,342, 5,146,715, 5,325,635 and DE 3,534,425.

The '954 patent is directed to an apparatus for grinding an edge of a planer glass workpiece where the workpiece is clamped to a rotatable table relative to an edge grinder. The edge grinder is movably connected to the supporting platform. A computer controls the operation of motor assemblies to position each of the assemblies in accordance with predetermined stored data relating to the particular shape of the glass workpiece. The computer also receives signals from sensors in order to determine when the workpiece is properly positioned within the glass grinding apparatus. In the apparatus of the '954 patent, the grinder moves around the periphery of the workpiece. The '780, '811, '091, '844, '229, '959, '342, and '715 patents similarly disclose controlled movement of the glass workpiece with respect to the grinder where both the grinding tool and the workpiece are moved relative to one another.

The '635 patent discloses two rotatable glass-supporting tables associated with two grinding heads mounted on the outer ends of opposing displacement guides. The abrasive disc is vertically adjusted to compensate for the glass thickness. The grinding head is maintained at a stationary position for convenience service or maintenance and the abrasive disc is vertically adjustable (according to glass thickness). All other prior art discloses planetary grinding mechanisms wherein the grinding wheel moves around the stationary sheet of glass. These planetary-type grinders of the prior art have several drawbacks including costs, floor space occupied, and messiness. In planetary-type grinders it is difficult to enclose the grinding head, therefore water and glass particles splash causing a hazard to operators.

SUMMARY OF THE INVENTION

This invention is directed to a process and apparatus to quickly, safely and cleanly grind the edge of a glass sheet.

This invention is directed to a process and apparatus for grinding an edge of glass sheet at a stationary grinding wheel. A sheet of glass having a predetermined thickness is located on the grinder, secured, lifted to the height of a grinding wheel corresponding to the pre-determined thickness of the glass sheet, moving the glass sheet toward and away from the stationary grinder while simultaneously rotating the glass about an axis perpendicular to the sheet.

This invention provides a clean and inexpensive apparatus and method of rapidly grinding an edge of a sheet of glass. The method involves locating a sheet of glass on a support surface. The sheet is then lifted by a rotatable support which is moveable through two axes. The sheet of glass is moved along the first axis to a predetermined height, corresponding to the grinding wheel having a thickness suitable for grinding the sheet of glass. The sheet of glass is then moved along the second axis until the sheet makes contact with the grinding wheel. The sheet is then translated to maintain contact with the grinding wheel while the glass is rotated about a predetermined axis. Once the entire periphery of the glass has been ground, the glass sheet is moved along the first and second axes and replaced on the support surface. By this method the glass sheet is ground at substantial cost savings over the planetary grinders of the prior art.

The stationary multi-grinder includes a plurality of stacked grinding wheels. Since the multi-grinder is stationary, it is possible to enclose the multi-grinder in a housing having individual slots to receive the glass. These slots are substantially sealed by opposed sheets of rubber or other suitable elastomeric material to prevent the cooling and rinsing fluid from is escaping. More specifically, the housing includes fluid outlets which direct the coolant and rinse fluid directly at the grinding wheels.

Other benefits, advantages and objectives of this invention will be further understood with reference to the following detailed description.

DETAILED DESCRIPTION OF THE DRAWINGS

Figure 1:
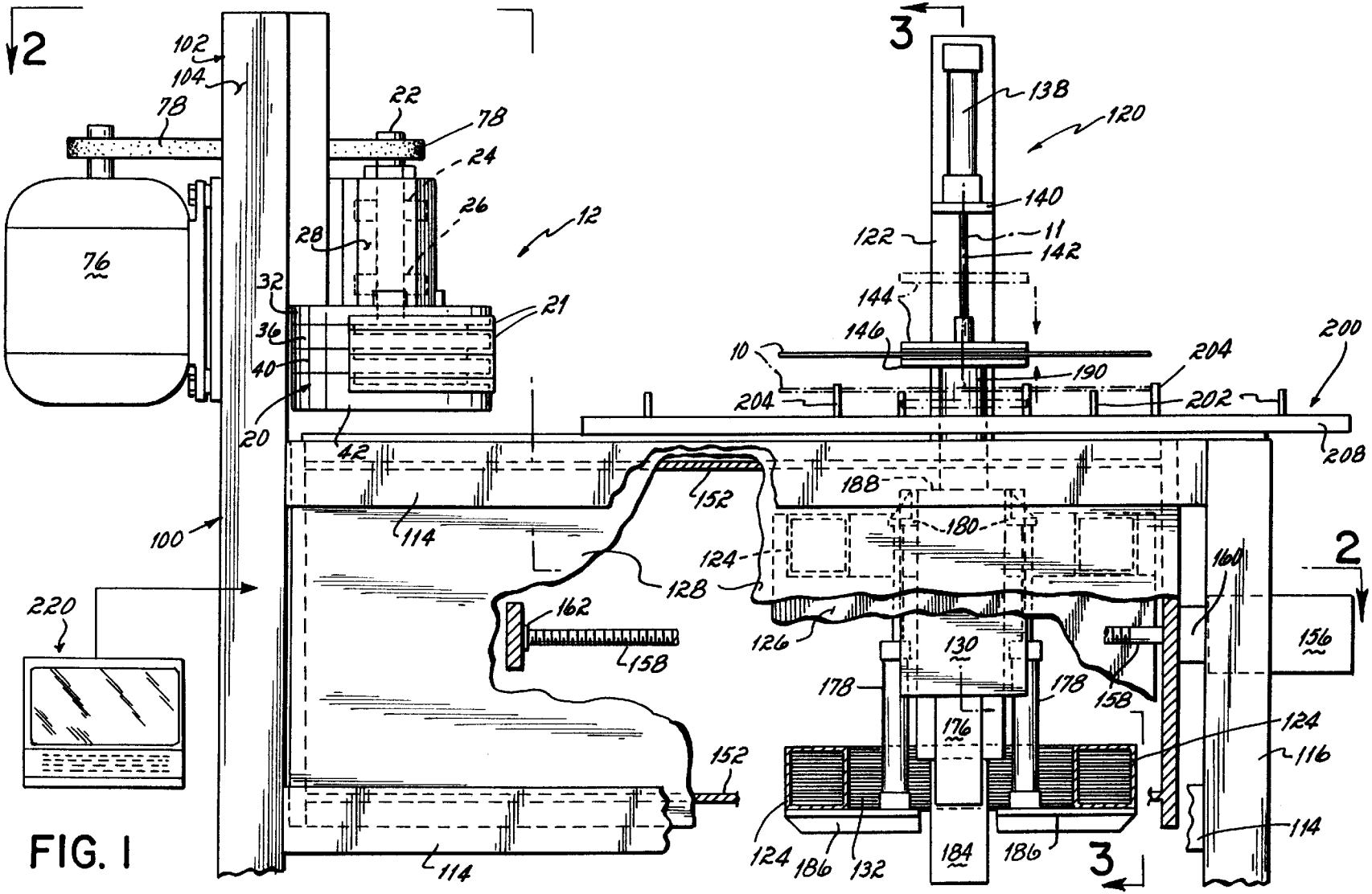
FIG. 1 is a front plan view, partially cut away, of the glass grinder of the present invention.
Figure 2:
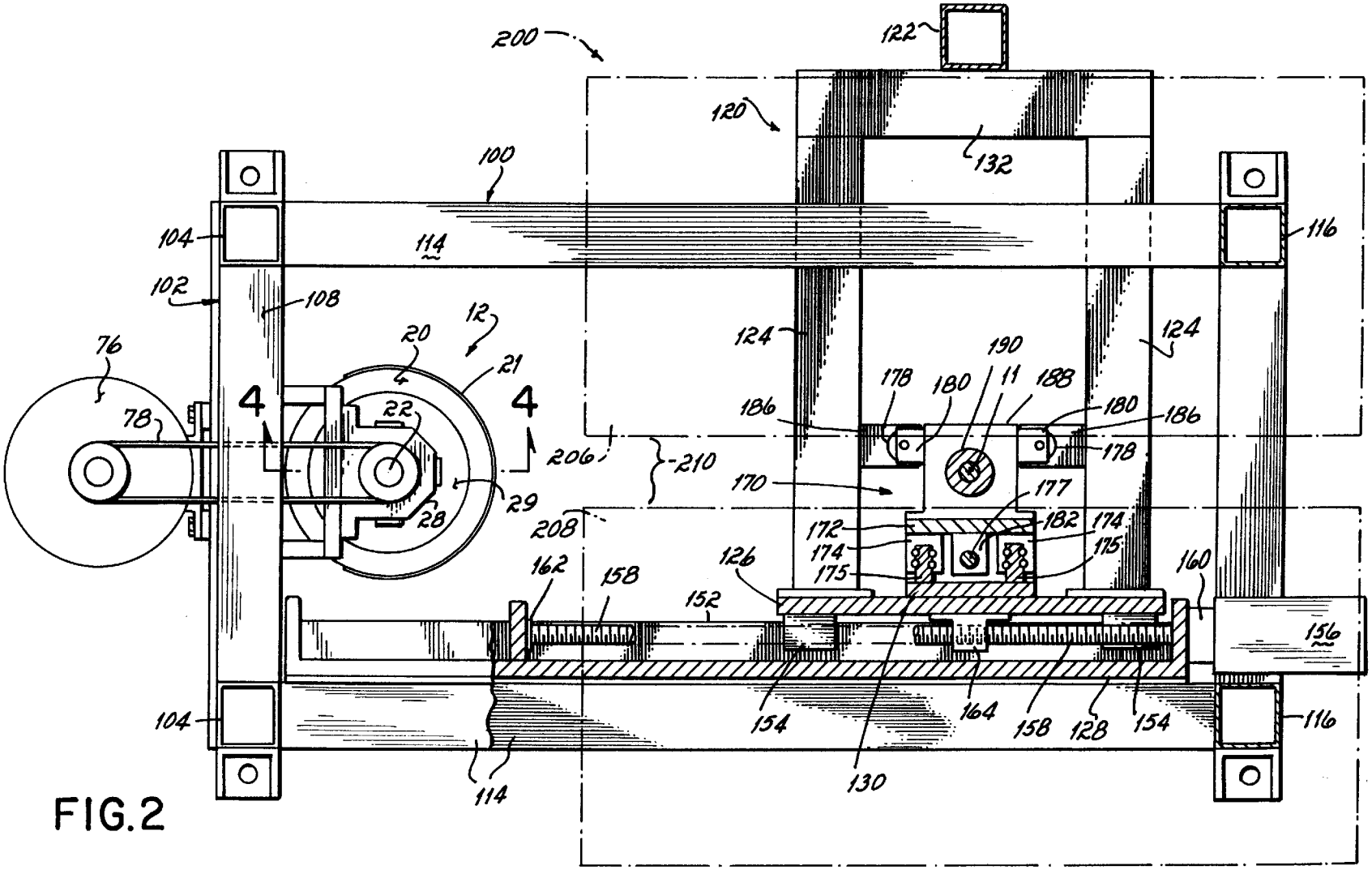
FIG. 2 is a top plan view of the glass grinder of the present invention taken along line 2—2 of FIG. 1.
Figure 3:
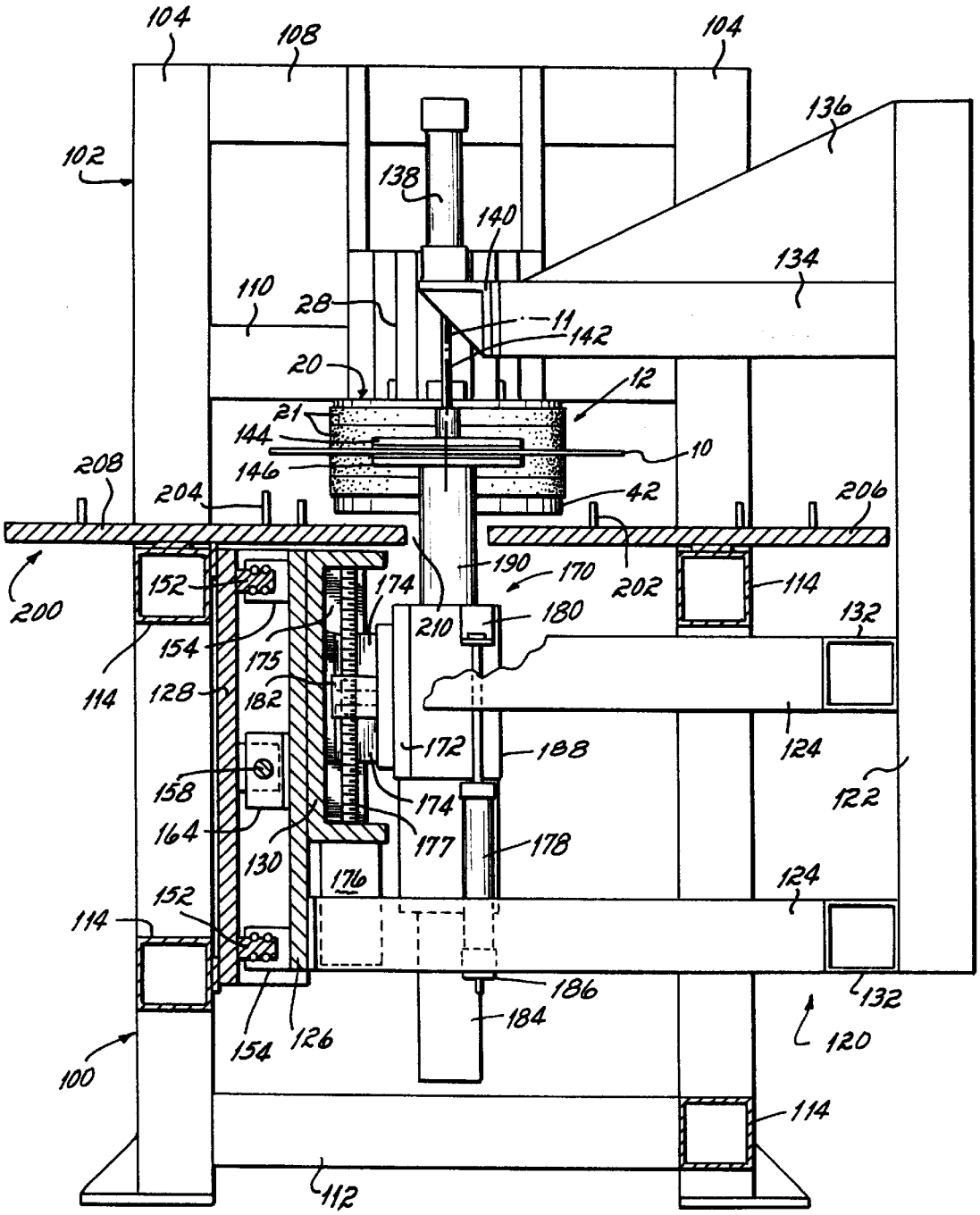
FIG. 3 is a side plan view of the glass grinder of the present invention, partially cut away, taken along line 3—3 of FIG. 1.
Figure 4:
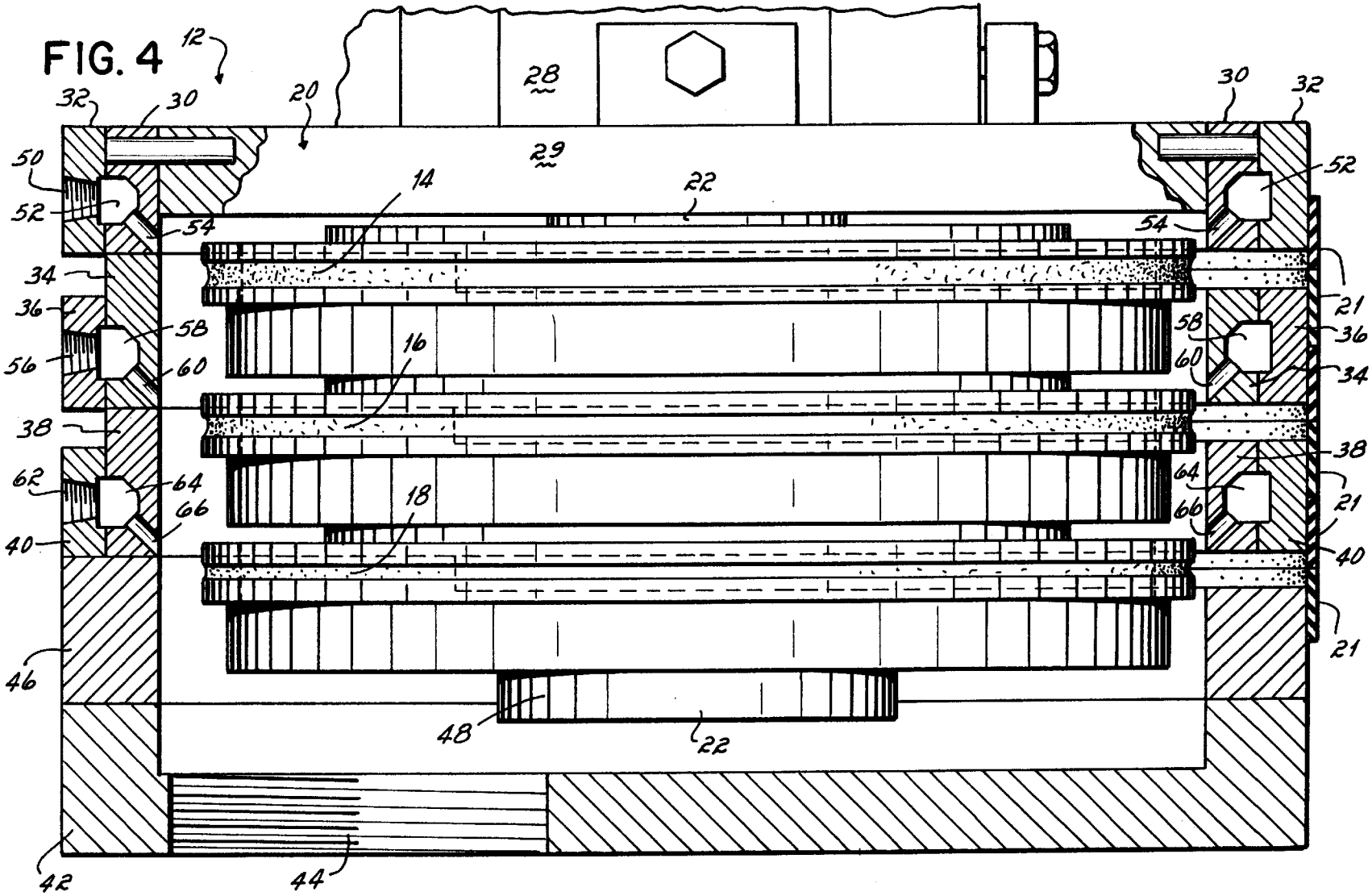
FIG. 4 is a cross-sectional view of the multi-grinder of the present invention.
Figure 5:
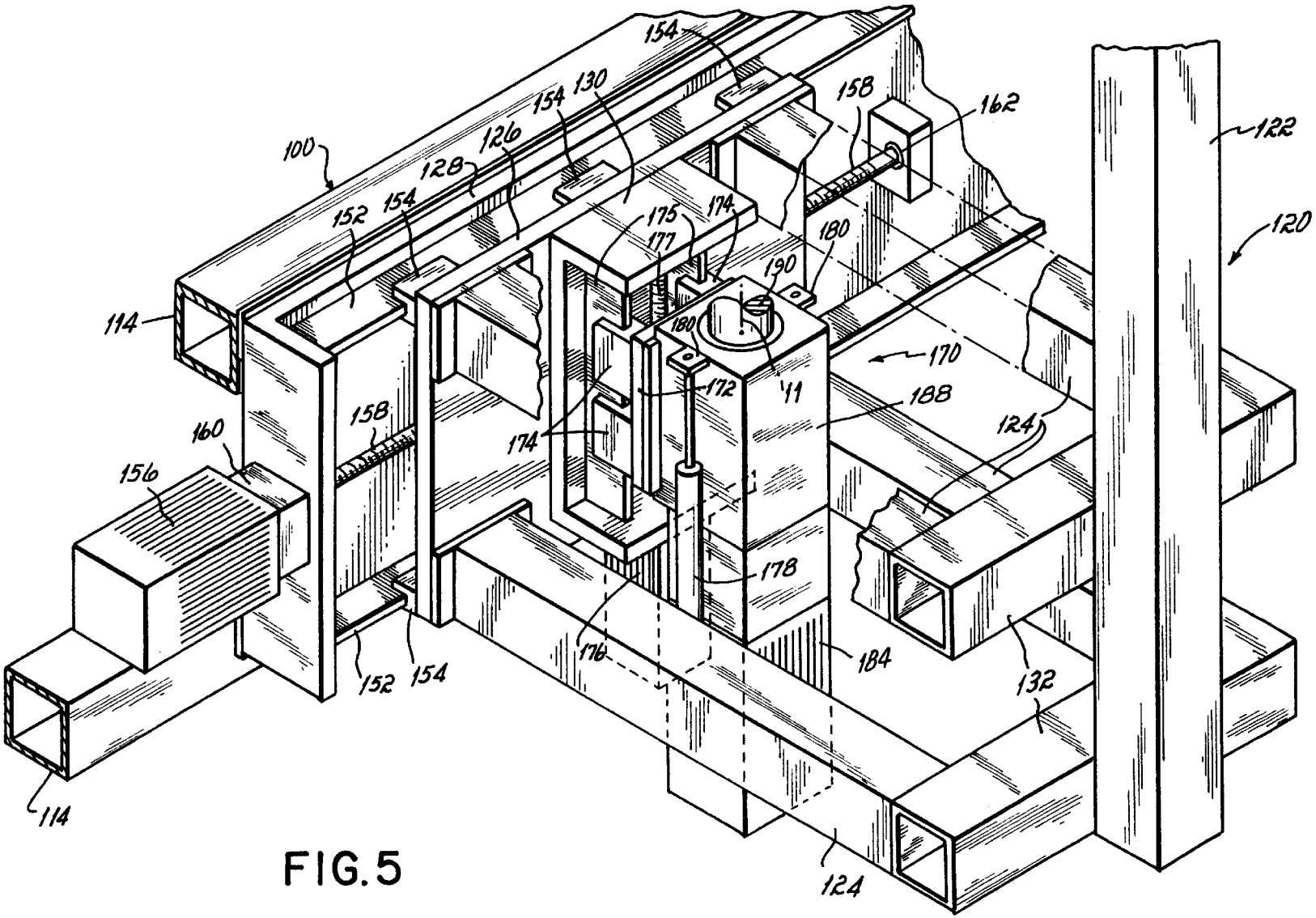
FIG. 5 is a schematic perspective view of the first and second axis controllers of the present invention taken along line 4—4 of FIG. 2.

It is the primary objective of this invention to provide a method and apparatus for grinding the edge of a sheet of glass quickly, inexpensively and safely. The present invention will now be described in detail with reference to the accompanying drawings wherein like structures are designated by the same numbers throughout the figures.

In a preferred form, the glass sheet 10 is rotated about a central axis 11 while held in contact with multi-grinder shown generally as 12. The multi-grinder 12 includes a housing 20 having a plurality of stacked grinding wheels 14, 16, 18 which may be suited for grinding glass of different edge thicknesses. In high production runs it is possible to mount similar grinding wheels in the multi-grinder 12 so that down time is minimized. Multi-grinder 12 includes spindle 22 and spindle bearings 24, 26. A substantial portion of spindle 22 is enclosed in a upper housing support 28 which is mounted to grinder stanchion 102. The grinding wheels are surrounded by the grinding wheel housing 20 to retain coolant water and glass grindings until they are exhausted through a drain 44. This housing 20 has a plurality of flexible and slitted sleeves 21 to prevent rinse water and glass from spraying outside the housing and creating an undesirable work area and possibly injuring an operator.

Housing flange 29 is mounted to the lower portion of housing support 28. The upper grinding wheel 14 is enclosed by housing flange 29, top inner nozzle plate 30, and top outer nozzle plate 32. The inner and outer nozzle plates 30, 32 includes annular grooves which, when plates 30, 32 are mated, form a fluid distribution channel 52. The outer nozzle plate 32 includes fluid inlet 50 while the inner nozzle plate 30 includes fluid outlets 54 which direct streams of rinse fluid at the top grinding wheel 14, while multi-grinder 12 is in use. Similarly, inner and outer nozzle plates 34, 36, mate to form fluid distribution channel 58. The outer nozzle plate 36 includes fluid inlet 56 and the inner nozzle plate 34 includes fluid outlets 60, which direct streams of fluid at the middle grinding wheel 16, while multi-grinder 12 is in use. Inner and outer nozzle plates 38, 40 mate to form a fluid distribution channel 64. Outer nozzle plate 40 includes fluid inlet 62 and inner nozzle plate 38 includes fluid outlets 66 which direct streams of rinse fluid at bottom grinding wheel 18 while multi-grinder 12 is in use.

A positive displacement fluid pump (not shown) is connected to fluid inlets 50, 56 and 62 for supplying a flow of rinse fluid while multi-grinder 12 is in use. The grinding wheel housing 20 is sealed by lower housing flange 42 which is spaced from the nozzle plates 38, 40 by lower housing spacer 46. The lower housing flange 42 includes the drain 44 to allow the rinse fluid to escape. The grinding wheels 14, 16 and 18 are non-rotatably fixed to spindle 22 and are secured at its lower end by a spindle flange 48.

During periodic maintenance, generally concurrent with replacement of grinding wheels 14, 16 and 18, it is possible to separate inner nozzle plate 30 from outer nozzle plate 32, inner nozzle plate 34 from outer nozzle plate 36, and inner nozzle plate 38 from outer nozzle plate 40 in order to clean annular channels 52, 58 and 64; fluid inlets 50, 56, 62; and fluid outlets 54, 60, 66. Once any debris is removed, the grinding wheels 14, 16 and 18 are replaced and housing and nozzle plates are reassembled.

The multi-grinder 12 and spindle motor 76 are mounted to a sturdy frame shown generally as 100. Specifically, the multi-grinder is mounted to the grinder stanchion 102 between horizontal grinder stanchion members 108, 110. The multi-grinder 12 is driven by spindle motor 76, also mounted to stanchion 102, in order to rotate the grinding wheels 14, 16, 18 by belt 78. A suitable 7.5 horsepower motor is available from Baldor. The grinder stanchion 102 includes vertical members 104 spaced apart by horizontal members 108, 110 and 112. All frame members are fabricated from structural tubing such as 4"×4" square tubing or other suitable material. The frame 100 also includes horizontal frame members 114 and vertical frame members 116 to support grinding carriage 120.

The grinding carriage 120 moves horizontally so that the glass sheet 10 may be picked up from support pins 202, translated to contact the multi-grinder and to hold the glass sheet 10 in contact with the multi-grinder while the glass sheet 10 is rotated about the central axis 11.

The horizontal carriage 120 includes upright arm 122, horizontal connecting members 124 which are fixed at their inner ends to a horizontally moveable support plate 126, moveable in the x-axis. Horizontal connecting arms 124 are connected at their distal ends to linking arms 132 which support upright arm 122. An upper arm 134 is cantilevered from arm 122 and is reinforced by bracket 136. The upper arm 134 includes a support bracket 140 for an air cylinder 138, for example, a 3 ¼" air cylinder readily available from Provenair, part series 38. Air cylinder 138 includes push rod 142 to force upper glass retainer 144 against lower glass retainer 146, in order to secure glass sheet 10 therebetween.

The horizontally moveable support plate 126 is slidable on upper and lower trays or rails 152 and slider/retainer members 154 to a fixed primary fixed support plate 128. The plate 128 is fixed to the front horizontal frame members 114 of frame 100. Upper and lower bearing rails 152 are mounted to primary support plate 128. Upper and lower slider/retainer members 154 move along bearing rails 152 such that the support plate 126 and hence the horizontal carriage 120 moves along the x-axis. Slider/retainer members 154 are mounted to x-axis support plate 126 which is moved in the x-axis by a servo-motor 156 rotating a threaded rod 158 to move x-axis traveler 164, fixedly secured to the plate 126, in the x-axis along the threaded rod. Servo 156 is mounted to the primary support plate 128 by coupling member 160. The opposite end of threaded rod 158 is mounted to primary support plate 128 by bearing 162. A suitable x-axis slide is available from Daedal as part number 424301p. Suitable servo-motors are available from Electro-Craft as part number BSA30, using part number BSA S-4030 amplifiers.

The vertical carriage, shown generally as 170, includes support plate 172 coupled to slider/retainer member 174. The slider/retainer members 174 are moveable along the y-axis on bearing rails 175 fixed to support plate 130, the support plate being mounted on x-axis support plate 126. A suitable y-axis slide is available from Daedal as part number 408061p. The vertical carriage 170 is driven in the y-axis by servo-motor 176, which is assisted by air cylinders 178, for example 2 ½" air cylinders readily available from Provenair. Air cylinder 138 and air cylinders 178 are selected to provide roughly equal and opposing forces to keep glass sheet 10 from rotating between glass retainers 144, 146 while the glass sheet 10 is in contact with multi-grinder 12. Air cylinders 178 counteract the force of air cylinder 138 so that servo-motor 176 is required only to lift the glass sheet to the height of a preselected proper grinding wheel. Air cylinder brackets 180 support the rods of air cylinders 178 and their cylinders are mounted to the lower horizontal connecting arms 124 of the horizontal carriage 120 by brackets 186. Servo-motor 176 rotates threaded rod 177 to move y-axis traveler 182 fixedly secured to y-axis support plate 172. Servo-motor 176 lifts glass sheet 10 to the proper height by moving the traveler 182 along threaded rod 177.

Rotational servo-motor 184 is mounted to y-axis support plate 172 by mount 188. Mount 188 includes the air cylinder support brackets 180 for receiving the push rods of air cylinders 178. After the glass sheet 10 has been lifted to the proper height by vertical carriage 170 and moved in the x-axis to be brought into contact with the multi-grinder 12 by the horizontal motion of horizontal carriage 120, the rotational servo-motor 184 rotates lower spindle 190 which is coupled to lower glass retainer 146. The glass is translated by the horizontal carriage during rotation so that the edge remains in contact with the grinding wheel. A suitable gear box for the rotary axis is available from Bayside Controls as part number PG142.

A support surface, shown generally as 200, is mounted to an upper portion of frame 100. The support 200 includes opposing support surfaces 206, 208 which are separated to form channel 210 there between. The lower spindle 190 moves along channel 210 between the opposing support surfaces 206, 208. Each support surface 206, 208 includes a substantial number of holes to receive support pins 202 and locator pins 204. Support pins 202 are generally shorter than locator pins 204.

A computer 220 such as an IBM-compatible microcomputer is provided to control spindle motor 76, x-axis servo-motor 156, y-axis servo-motor 176, rotational servo motor 184, lower air cylinder 178 and upper air cylinder 138, as well as other components of the machine such as a solenoid for regulating the flow of coolant to grinding wheel housing 20. Software for driving computer 220 is described below and incorporated into the appendix attached to this application.

Figure 6:
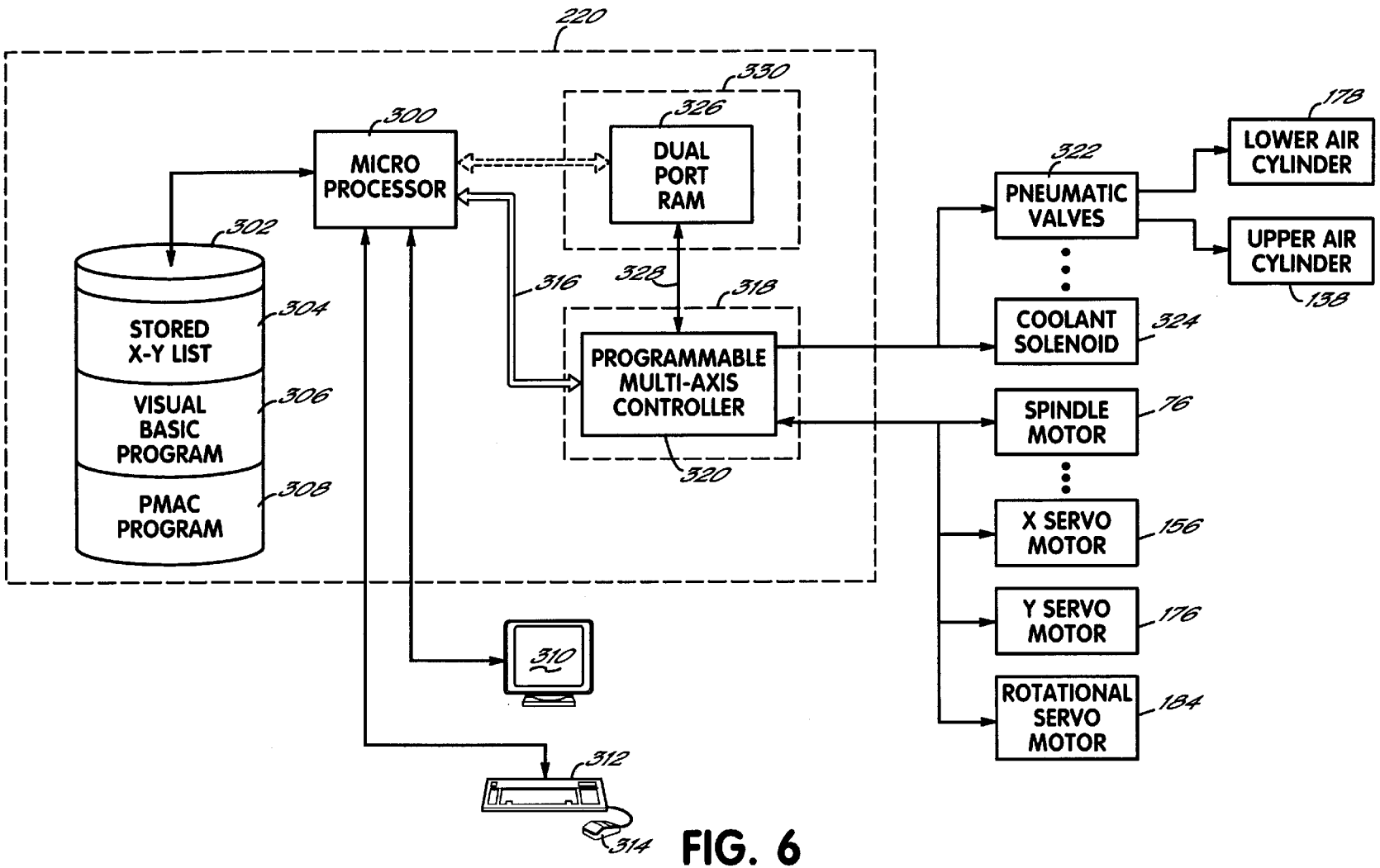
FIG. 6 is an electrical block diagram of the computer circuitry controlling the multi-grinder of the present invention.

Referring now to FIG. 6, computer 220 is an IBM-compatible microcomputer based on a 80486 compatible microprocessor 300 such as is available from Intel Corporation, having for example four MBytes of memory and 120 MBytes of hard disk drive storage space. Microprocessor communicates with an internal hard disk drive 302 storing various data for controlling the computer and machine, including an operating system for low-level control of microprocessor 300, such as MS-DOS version 6.2 and Microsoft Windows version 3.1, both available from Microsoft Inc. of Redmond, Wash.

Desired part outlines are prepared using a computer aided design program such as "AutoCAD", and stored on hard disk drive 302 in files 304. These files take the form of X-Y lists 304 of coordinates indicating the outline of a glass part to be fabricated by the machine, formatted in accordance with the G code standard (EIA Standard 274). These X-Y lists 304 are read and used by microprocessor 300 to control operations of the machine. Further details of the nature of these lists are elaborated below.

To facilitate control of the machine and interaction with the user, microprocessor 300 uses Visual Basic programs 306. Programs 306 control microprocessor 300 in reading X-Y lists 304 and converting these lists to instructions for controlling the machine, and also cause the computer 220 to interact with a user via displays (see below) on a touch-screen monitor 310 and/or input from a keyboard 312 and pointing device 314. Programs 306 are written in the "Visual Basic" source language and compiled using the Visual Basic compiler available from Microsoft. These programs are described in further detail below and source listings are provided in the microfiche appendix.

Hard disk drive 302 also stores further programs 308 used as described below for low-level control of the machine elements.

Computer 220 communicates with touch screen monitor 310, keyboard 312 and/or pointing device 314 via standard IBM compatible keyboard, monitor and communications port interfaces. Furthermore, computer 220 communicates with various elements of the glass grinding machine via its ISA expansion bus 316. Specifically, an ISA expansion card 318 plugged into the ISA bus 316 of computer 220 carries a programmable multi-axis controller (PMAC) 320, which is an independent microprocessor specifically designed for machine-control environments, such as the PMAC sold by Delta Tau Data Systems of Northridge, Calif.

Microprocessor 300 loads programs 306 to PMAC 320 during initialization of the system, and thereafter PMAC 320 uses programs 306 to respond from instructions from microprocessor 300 to control various machine elements. (Programs 306 are also illustrated in the microfiche appendix attached to this application.) These machine elements include pneumatic valves 322 for supplying pressurized fluid to upper and lower air cylinders 138 and 178, as well as the spindle, x-servo, y-servo, and rotational servo motors 76, 156, 176 and 184. PMAC 320 also controls a coolant solenoid 324 to regulate coolant flow to the grinding wheel housing 20.

In the software illustrated in the attached microfiche appendix, microprocessor 300 communicates directly with PMAC 320 via ISA bus 316 by a synchronous communication. In an alternative embodiment illustrated in FIG. 6, these communications may be made asynchronous by providing a dual-port random access memory (RAM) 326 as a buffer between microprocessor 300 and PMAC 320. In this embodiment, microprocessor 300 may store Instructions to the PMAC into dual-port RAM via ISA bus 316, and PMAC 320 may read instructions (and store responses as needed) through a ribbon cable 328 or other connection. Dual port RAM may reside on a second ISA expansion card 330, or be otherwise connected between microprocessor 300 and PMAC 320.

DETAILED DESCRIPTION OF THE OPERATION OF THE INVENTION

The method of using the machine of the present invention will now be described in reference to the accompanying drawings. Prior to beginning the production run of a predetermined shape of glass sheet 10, that shape will be coded into computer 220 along with the position of locator pins 204 so that the rotational axis of the glass sheet 10, corresponding to the rotational axis of rotational servo-motor 184 may be determined. The machine operator then places glass sheet 10 on support pins 202 and adjusts the glass sheet 10 so that it contacts a predetermined position of selected support pins 204. Once the glass sheet 10 has been placed in the proper location, the machine operator via touch screen, mouse or other computer-input device instructs computer 220 to begin the grinding operation. The first step is to activate air cylinders 138 and 170 in order to securely hold the glass sheet 10 between upper glass retainer 144 and lower glass retainer 146. Preferably the glass retainers include a sheet of elastomeric material on the surfaces which abut the glass sheets to improve grip. The y-axis servo-motor 176 then rotates threaded rod 177 to lift the vertical carriage 170 and glass sheet 10, to the proper height. This predetermined height is equal to the height of the grinding wheel which has the desired edge profile. The horizontal carriage 120 is then moved in the x-axis by the rotation of threaded rod 158 by the x-axis servo-motor 156. Once the glass sheet 10 comes in contact with the proper grinding wheel, computer 220 instructs the rotational servo-motor 184 to rotate spindle 190 and thereby rotate the glass sheet. As the glass sheet rotates, x-axis servo-motor 156 moves the horizontal carriage 120 to maintain contact between the edge of the glass sheet 10 and the grinding wheel.

Once the entire periphery of the glass sheet 10 has been ground, x-axis servo-motor 156 is activated to return the horizontal carriage 120 to the starting position. The y-axis servo-motor then lowers the glass to the support pins and the air cylinders are deactivated to withdraw upper glass retainer 144 and lower glass retainer 146. The operator then removes the glass sheet 10 for subsequent heat treatment, drilling or shaping processes.

Figure 7A:
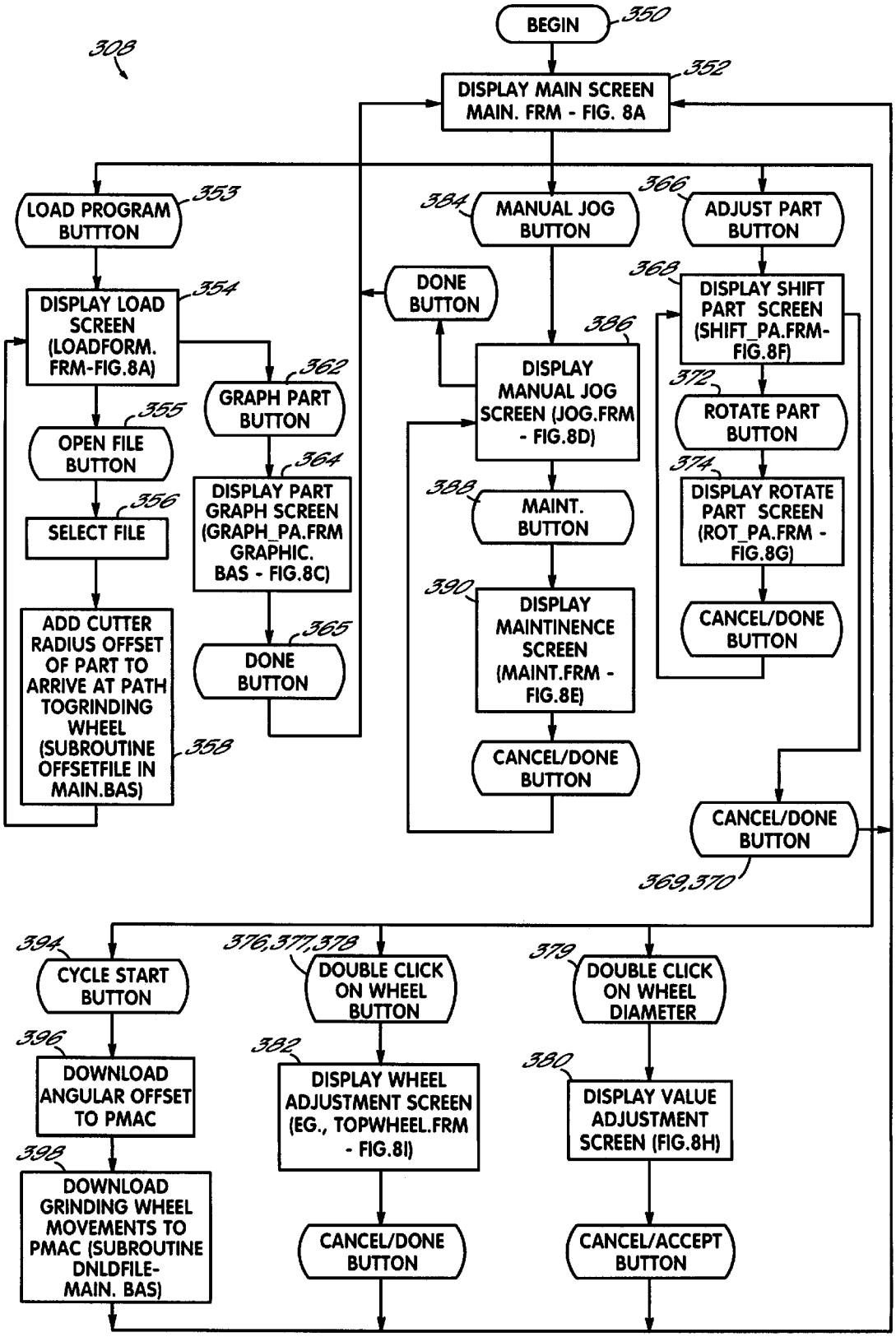
FIGS. 7A and 7B are flow charts of the Visual Basic software used in the computer controlling the multi-grinder.
Figure 7B:
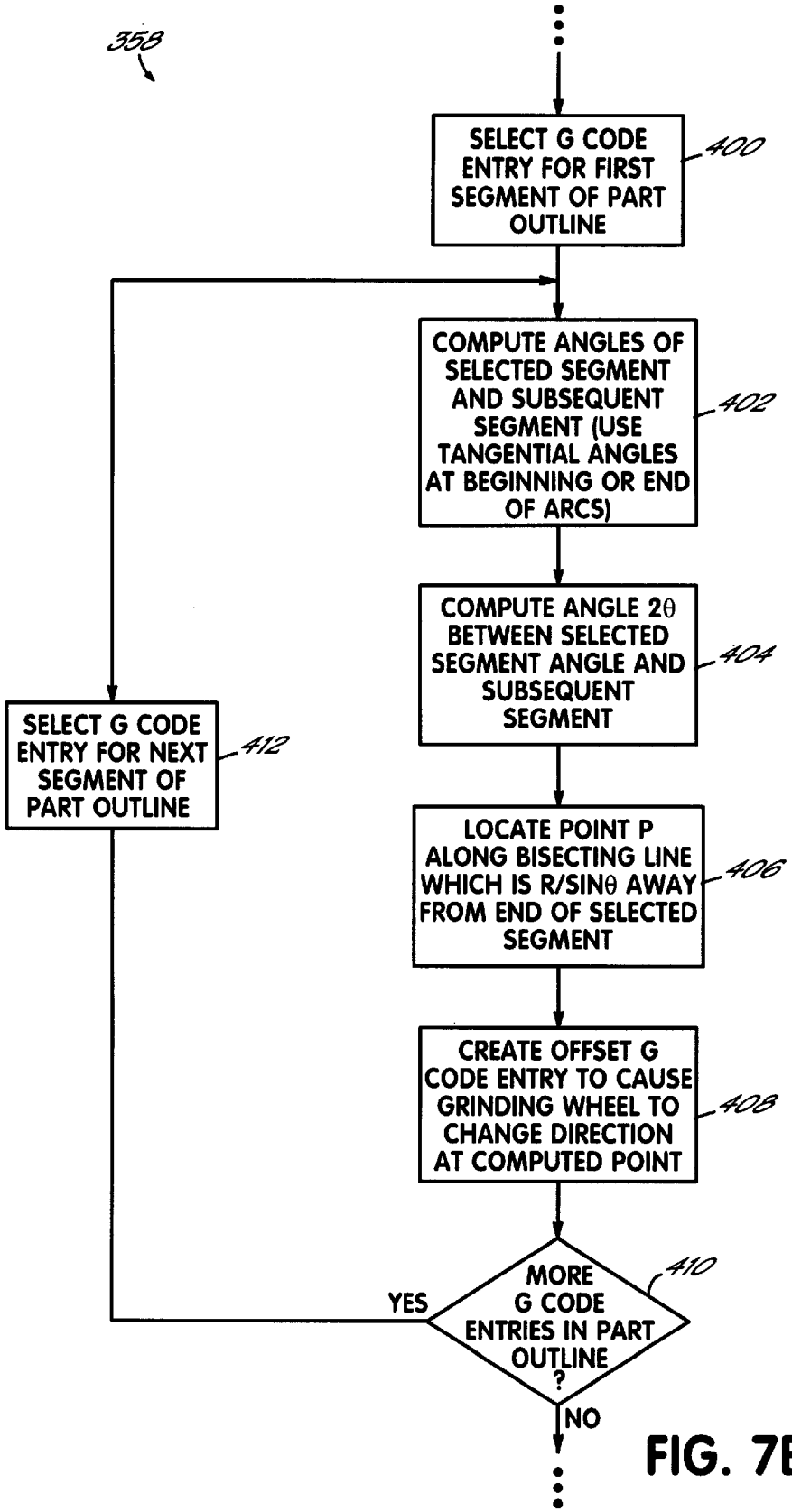

These operations will be better understood with reference to the flow charts of FIGS. 7A–7B, screen displays of FIGS. 8A–8I, and illustrations of FIG. 9A–9D, which summarize the operations performed by the Visual Basic programs 306 stored in the hard disk drive 302 of the computer 220.

As noted above, the input of the Visual Basic program is a stored X-Y list 304 formatted in accordance with G-code format. The output of the program is a similar "offset" X-Y list in G-code format defining movements of the grinding wheel necessary to create the desired part, and additional commands for operating the grinding wheel. These outputs are delivered to the PMAC 320 which converts them into the appropriate control signals to the various components of the machine such as those shown in FIG. 6 to cause the desired movements. (The program in the PMAC 320 for providing these functions is provided in the attached appendix.)

When computer 220 is rebooted, it executes the Visual Basic program, starting at step 350, FIG. 7A. After initializing various variables, in step 352 the program uses the code found in the appendix file MAIN.FRM to display the main control screen, which is illustrated in FIG. 8A.

It will be understood that Visual Basic is primarily an "event-driven" rather than "procedural" programming language, i.e., software written for Visual Basic is typically structured around various display screens and associated states of operation, and the defines actions to be taken in response to user input to transition from one display/state to another display/state. Thus, the flow charts of FIGS. 7A and 7B identify the various displays and states provided by the Visual Basic software and the important events which cause transitions from one state/display to another.

Figure 8A:
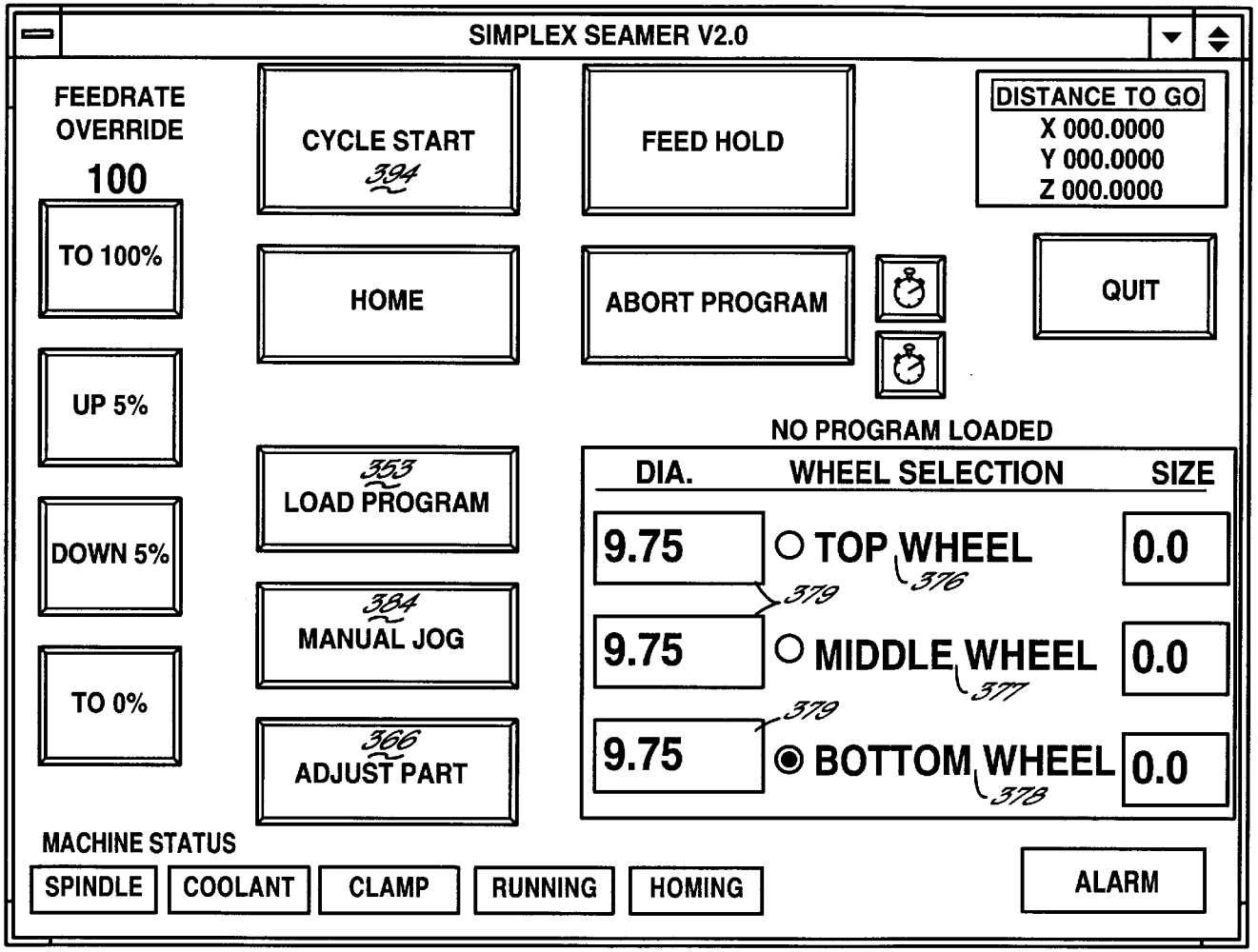
FIGS. 8A, 8B, 8C, 8D, 8E, 8F, 8G, 8H and 8I are illustrations of screen displays produced by the Visual Basic software.

As can be seen in FIG. 8A, various operations can be undertaken from the main screen, including loading programs (button 353), adjusting the program (button 366), adjusting the machine (button 384), and initiating a cycle (button 394). In the following a typical procedure for loading, adjusting, and running a program will be outlined.

Figure 8B:
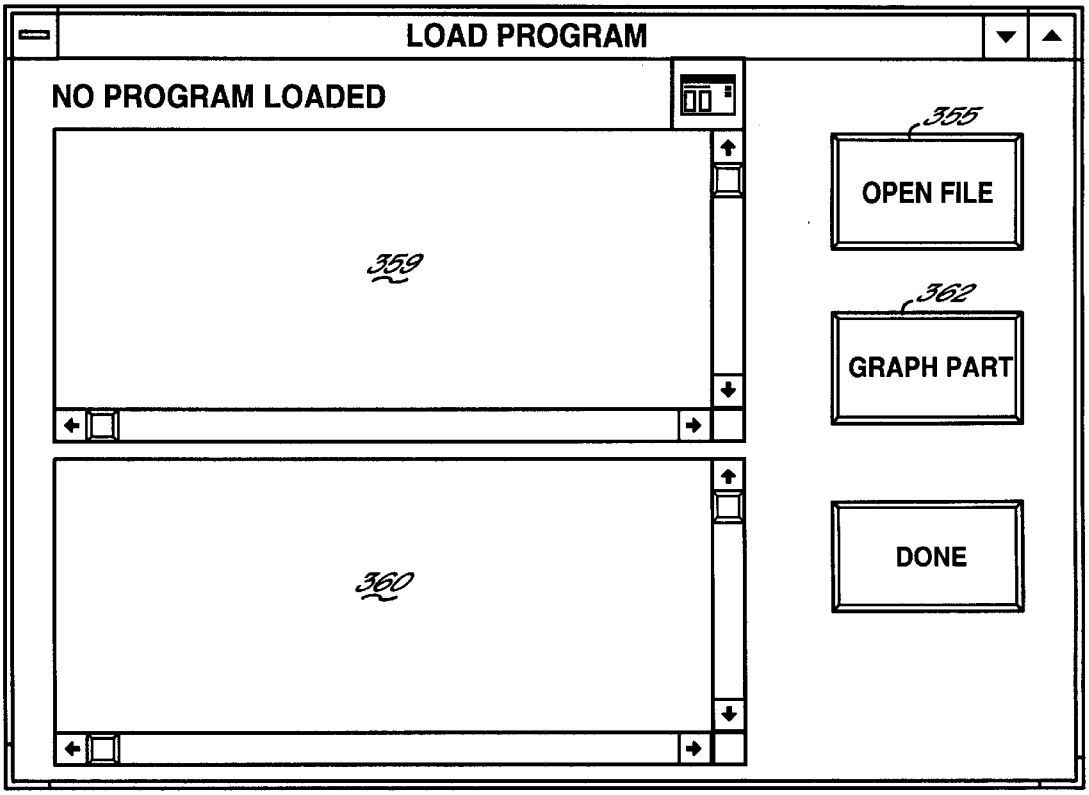

From the main screen, "pushing" the "LOAD PROGRAM" button 353 will cause the program to sequence to step 354 and display the LOAD PROGRAM screen seen in FIG. 8B. This screen is produced by the code LOADFORM-.FRM file in the attached appendix. The LOAD PROGRAM screen is used to select and view a G-code formatted file 304 in hard disk 302. It will be noted that the user "pushes" a button by touching the screen of display monitor 310 at the location of the button; monitor 310 has a touch screen which reports this contact to microprocessor 300; a Visual Basic driver is used to detect the contact and invoke the operations assigned to the button which is displayed in the contacted area. Similar functionality could be achieved with a mechanical pointing device such as a mouse 314; however, for manufacturing environment a touch screen has been found intuitive for users to operation.

Once in the LOAD PROGRAM screen (step 354/Fig. 8B), a program may be loaded by pressing the "OPEN FILE" button 355; doing so will invoke the standard Windows file selection dialog box (not shown), allowing the user to select the desired file (step 356).

Once a file has been selected, the Visual Basic program proceeds to step 358 to use the selected G-code file to determine the path that the center of the grinding wheel should follow to create the desired part. This operation involves adding an offset to the part outline to compensate for the radius of the grinding wheel. The code for performing this operation is in the subroutine OFFSETFILE which is found in the file MAIN.BAS in the appendix, and the specific operations for performing this task are summarized in FIG. 7B and illustrated with reference to FIGS. 9A–9D, below. As the offset grinding wheel path is computed by this subroutine, it is stored in the memory of computer 220 as a second G-code file.

At the completion of step 358, the Visual Basic program returns to step 354 and displays the load screen (FIG. 8B) once again. At this time, the G-code of the loaded program is displayed in window 359 of the LOAD PROGRAM screen, and the offset G-code for the path of the grinding wheel, computed in step 358, is identified in window 360.

Figure 8C:
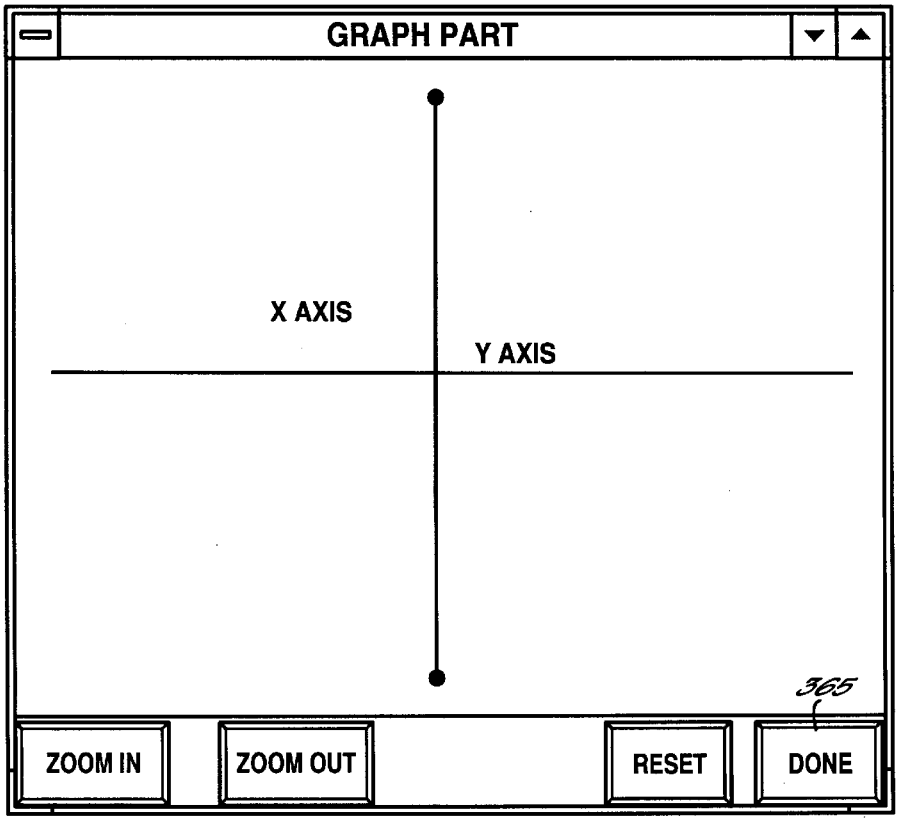
Figure 8D:
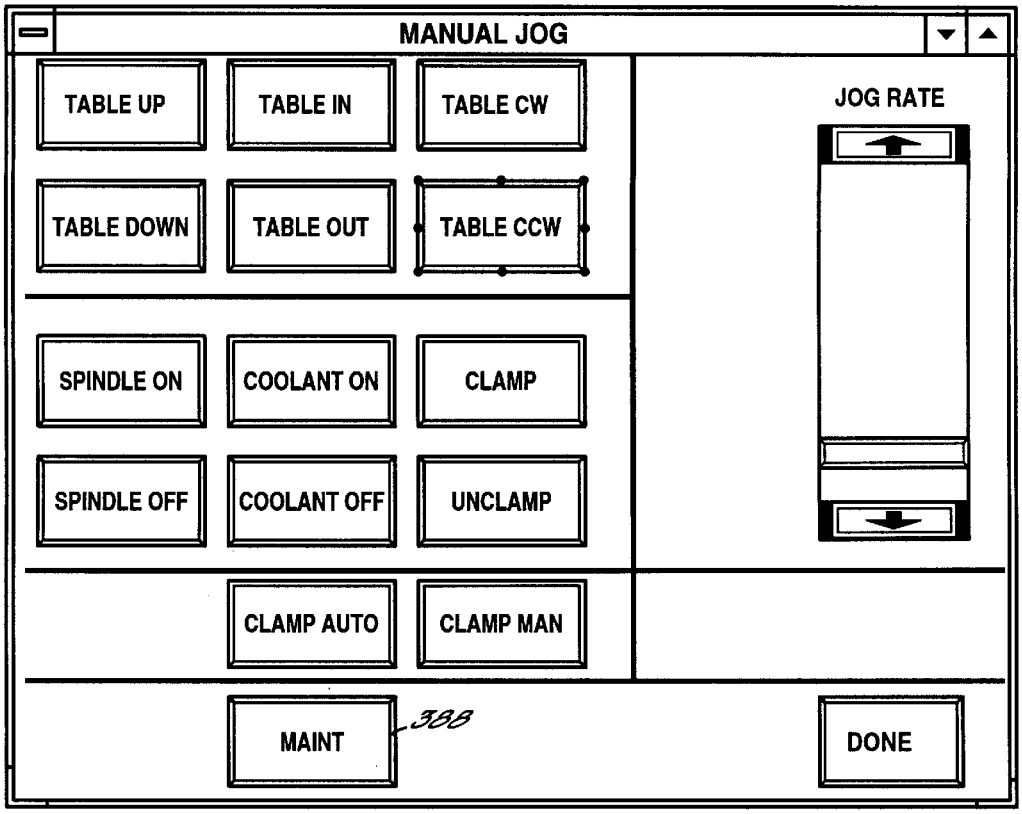

To permit the user to visualize the outline of the part, and the computed grinding wheel path, the user may "push" the "GRAPH PART" button 362 on the LOAD PROGRAM screen to move to the GRAPH PART screen (step 364/FIG. 8C). This screen is created by the code in the GRAPH-PA.FRM file, using subroutines found in the GRAPH-IC.BAS file in the appendix. The GRAPH PART screen graphically displays the outline of the part and the computed path of the grinding wheel so that the user may verify that the part will be cut correctly. Buttons on this screen may be used to zoom into the graphic display to view specific areas.

There are three possible sources of error that can be detected by viewing the GRAPH PART screen. One source of error might be a G-code description of the part that is not properly centered, so that the part extends at some point beyond the operating range of the grinding wheel. If this is the case, the part can be re-centered using the SHIFT PART screen discussed below (FIG. 8F). It may also be desirable to rotate the part outline to fit the entire part within the operating range of the grinding wheel. This can be done using the ROTATE PART screen discussed below (FIG. 8G).

There may also be errors in the G-code file describing the part outline. A discontinuity or mistake in this file will be apparent when the part is graphically outlined.

A third possible source of error is a part that cannot be accurately ground due to mechanical limitations of the grinding wheel. For example, the grinding wheel cannot grind an inside corner having a radius less than the radius of the grinding wheel. If there is such a corner in the part outline defined by the original G-code file, the resulting grinding wheel path will have a uniquely recognizable contortion indicating that the wheel is unable to properly cut this feature. A problem of this sort might be solved by changing to a smaller-diameter grinding wheel on the main screen of FIG. 8A, as discussed below.

After viewing the graph of the part, the user may return to the main screen (step 352) by pressing the "DONE" button 365 (FIG. 8C).

As noted above, this graphic display of the part outline and grinding wheel path may indicate the need to shift the part outline relative to the grinding table. To do so, the users pushes the "ADJUST PART" button 366 on the main screen, causing the Visual Basic program to move to the SHIFT PART screen (step 368) shown in FIG. 8F. The SHIFT PART screen is produced by the code found in the SHIFT_PA.FRM file in the appendix. The SHIFT PART screen includes controls for shifting the location of the part outline relative to the grinding table in the X and Y directions. The user may shift the part in 0.001 or 0.01 inch increments until the part is at the desired location. When the desired X/Y shift has been produced, the user may press the DONE button to return to the main screen. The user may also reset the offsets to zero by pressing the ZERO button 371. If the user desires to cancel any changes created in the SHIFT PART screen, the CANCEL button 370 can be used to return to the main screen.

As noted above, the user may also wish to rotate the part. This is done by pressing the ROTATE PART button 372 on the SHIFT PART screen. Doing so will cause the Visual Basic program to move to the ROTATE PART screen (step 374) shown in FIG. 8G. The ROTATE PART screen is produced by the code found in the ROT_PA.FRM file in the appendix. The ROTATE PART screen includes controls for rotating the part clockwise or counterclockwise in 0.01 and 0.1 degree increments. The user may also press the ZERO button to reset the rotation to zero. Pressing either the CANCEL or DONE buttons will return the user to the PART SHIFT screen; as before, CANCEL will cancel any changes created in the ROTATE PART screen.

Returning to the main screen of FIG. 8A, the user may also adjust the operation of the glass grinding machine using controls on the main screen. For example, the user may select one of the three grinding wheels by pressing one of the three "radio buttons" 376, 377 or 378. This allows the user to alternate between grinding wheels, which may have different roughness, or different sizes. When the user selects a new grinding wheel, if the diameter of the new grinding wheel is different than that of the previously selected grinding wheel, the Visual Basic program re-computes the path of the grinding wheel to account for the differing diameter of the grinding wheel.

The main screen also displays the diameters of the wheels, which can be reset. Specifically, if the user pushes one of the three boxes 379 twice (i.e., double-clicks on the displayed diameter), the Visual Basic program will transition to step 380 and display the VALUE ADJUSTMENT screen illustrated in FIG. 8H. In this screen the user may press controls to increase or decrease the diameter of the selected grinding wheel. By pressing either the CANCEL or ACCEPT buttons the user will return to the main screen. If the user presses ACCEPT, the new diameter value will be stored and displayed on the main screen, and if the diameter has been changed the Visual Basic program will re-compute the path of the grinding wheel to account for the change.

The user may also enter fine adjustments for each grinding wheel, by pressing twice (double-clicking) on the appropriate radio button 376, 377 or 378. Doing so will cause the Visual Basic program to display one of three wheel adjustment screens (step 382), one of which is illustrated in FIG. 8I. The wheel adjustment screens are produced by the code found in the files TOPWHEEL.FRM, MIDWHEEL.FRM and BOTWHEEL.FRM. In the wheel adjustment screen the user may press controls to fine-position the vertical height of the selected grinding wheel, to ensure accurate placement of the grinding wheel on the edge of the glass.

The Visual Basic software may also be used to manually manipulate ("jog") the grinding machine, as may be needed for maintenance, cleaning and/or testing. To do so, the user may press the "MANUAL JOG" button 384 from the main screen of FIG. 8A, which causes the Visual Basic program to display the MANUAL JOG screen of FIG. 8D (step 386). The MANUAL JOG screen is created by the code found in the JOG.FRM file in the appendix. From the MANUAL JOG screen the user may manually rotate the table clockwise or counter-clockwise, move the table up or down, or in or out, control the spindle, clamp, and coolant flow. The "CLAMP AUTO" button is used to place the machine in a mode which automatically unclamps a part after a grinding cycle. The "CLAMP MAN." button is used to place the machine in a mode in which the clamp is not automatically released in this way, which allows the user to easily rerun a grinding cycle if desired without re-aligning the part to the grinding machine.

Figure 8E:
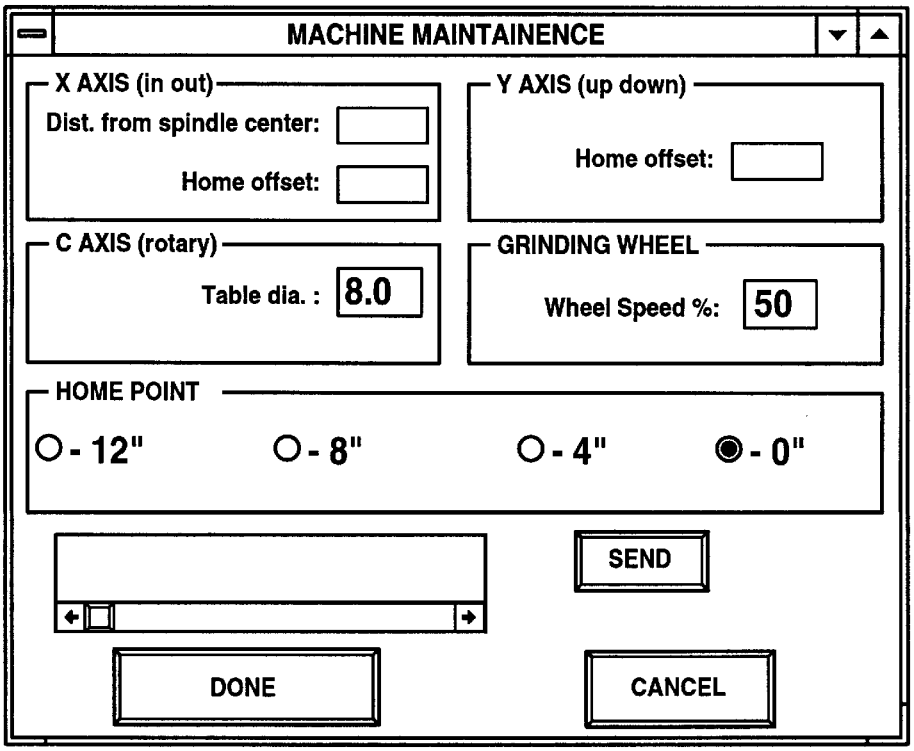
Figure 8F:
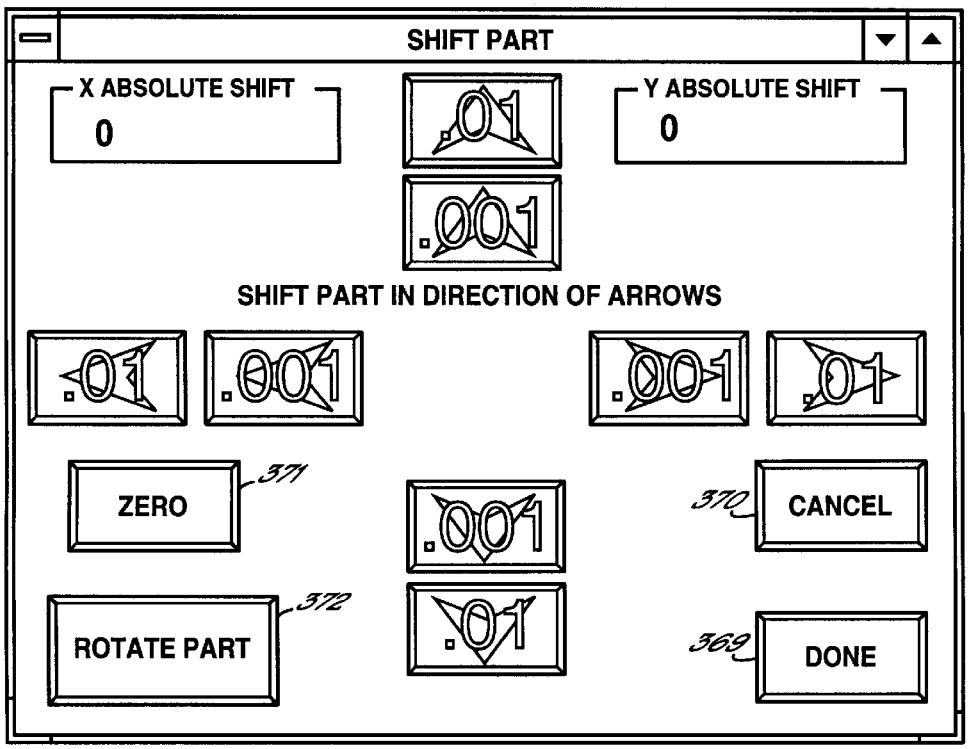
Figure 8G:
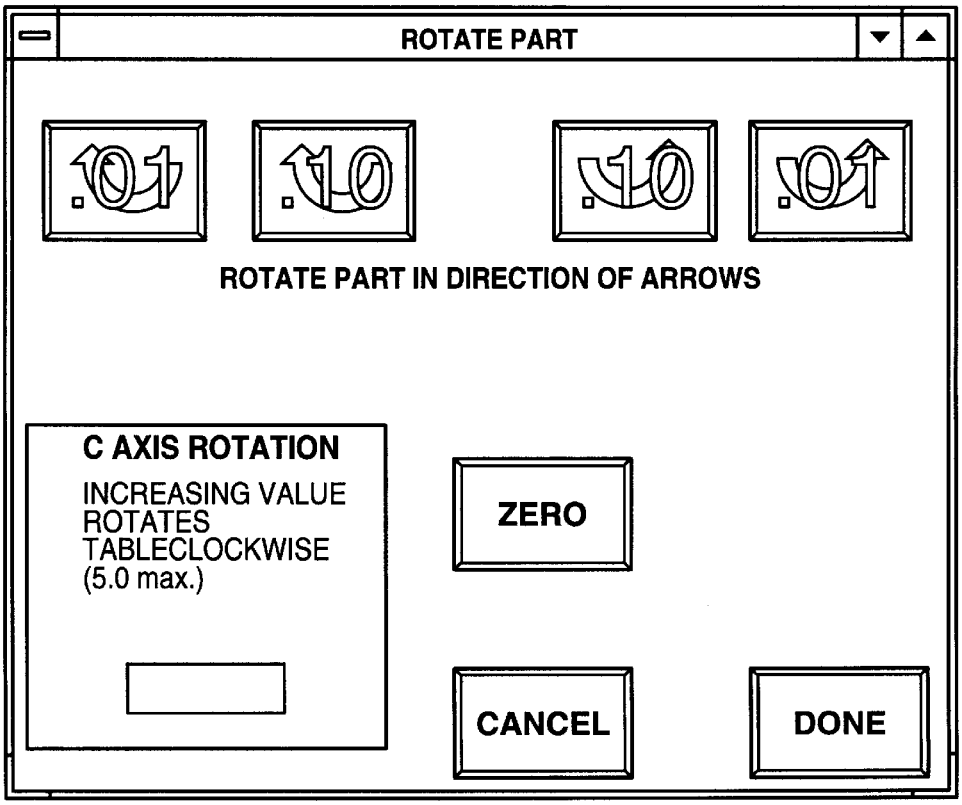
Figure 8H:
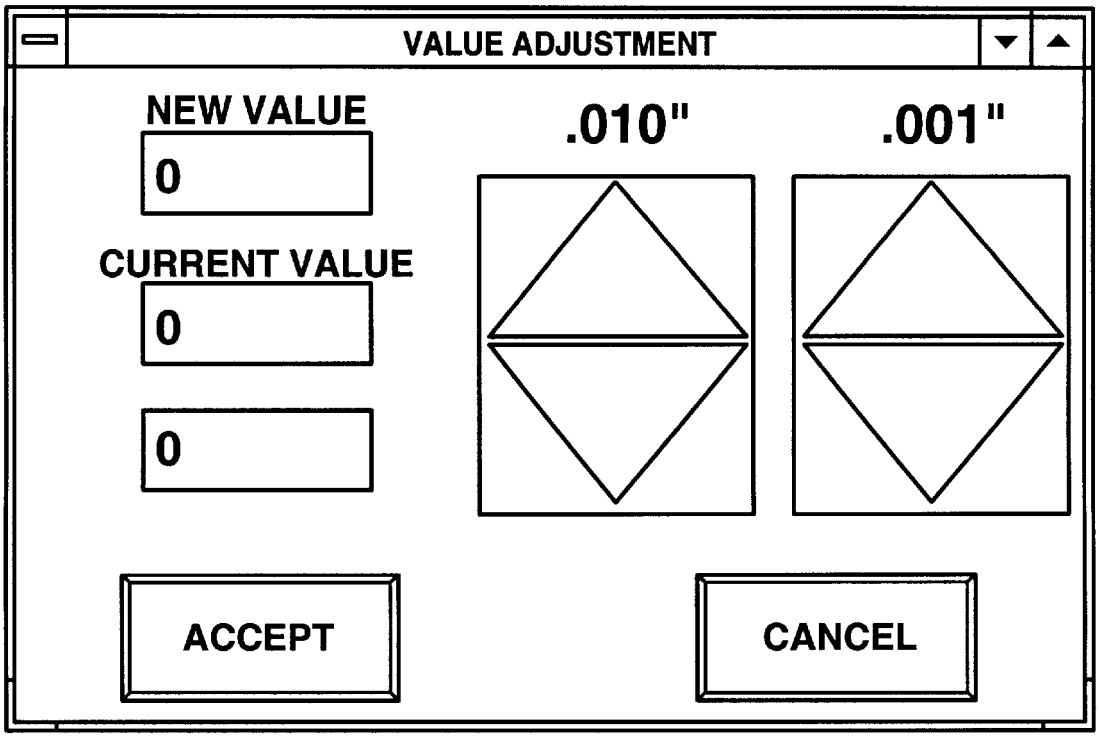
Figure 8I:
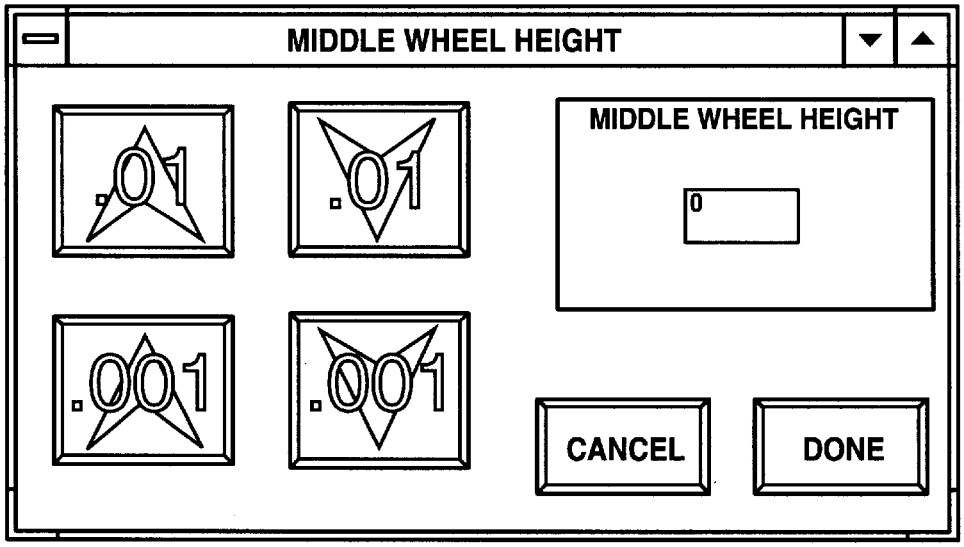
Figure 9A:
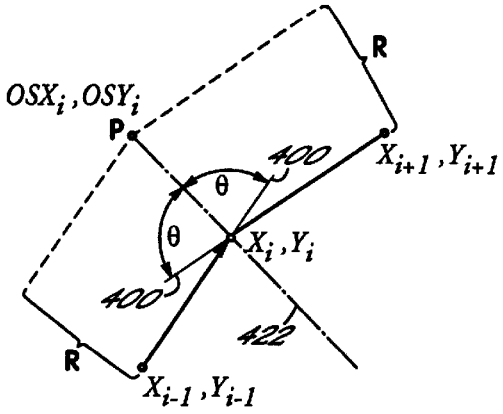
FIGS. 9A, 9B, 9C and 9D are graphical illustrations of the mathematical operations performed by the Visual Basic software in expanding the outline of a part to derive the path of the grinding wheel.
Figure 9B:
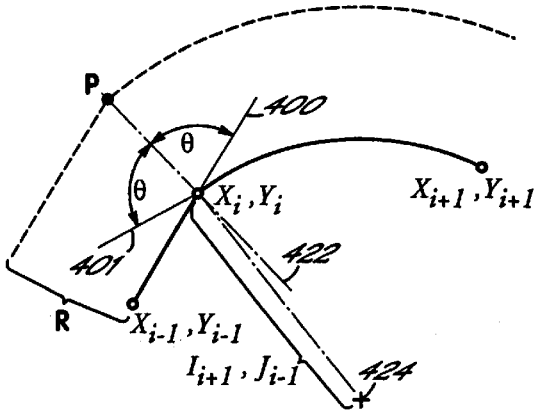
Figure 9C:
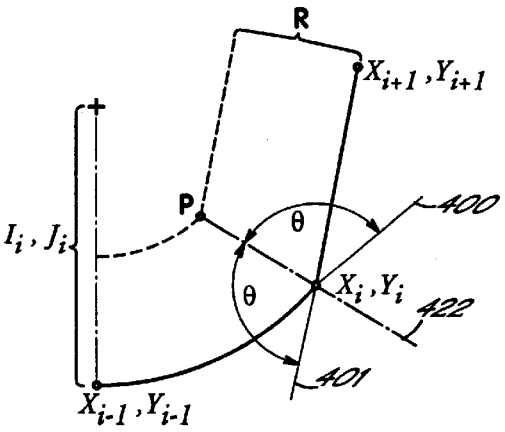
Figure 9D:
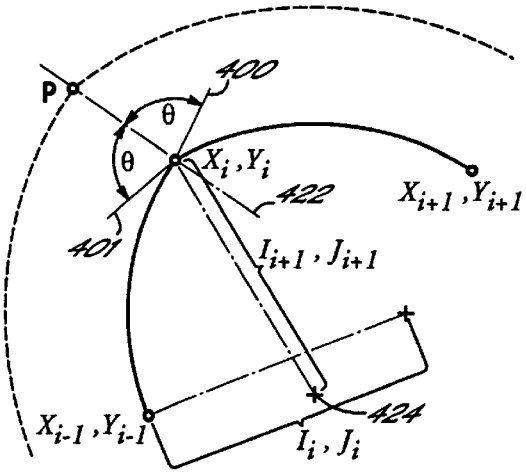

In the MANUAL JOG screen, the user may press the "MAINT" button 388 to cause the Visual Basic program to display the MACHINE MAINTENANCE screen (step 390) shown in FIG. 8E. At this screen the user may adjust various setup parameters, such as X and Y offsets (to ensure that the home position of the grinder is accurately centered on the table). Also, the table diameter and wheel speed can be adjusted. Furthermore, there is a provision to select one of four "home point" settings. The grinding machine may be used to grind smaller parts efficiently by selecting on of the −12", −8" or −4" home points (and moving the alignment pins on the table to the appropriate new locations), so that a smaller glass workpiece may be positioned on the table at a position which is initially closer to the grinding wheel, eliminating unnecessary translation of the grinding wheel during operation.

Finally, the main screen "CYCLE START" button 394 is used to initiate grinding of a part in accordance with the previously identified parameters. Pressing this button causes the Visual Basic program to transition to step 396, at which the Visual Basic program instructs the PMAC 320 to cause the table to rotate to the angular offset (if any) defined in the ROTATE PART screen (step 374/FIG. 8G). Then, in step 398 the Visual Basic program sequentially downloads the grinding wheel movements identified in the offset G-code file produced in step 358. The program loaded in the PMAC (which is provided in the appendix) causes the X-Y coordinates identified in the downloaded G-code file to be converted to radial coordinates for controlling the spindle and X servo motors to grind the outline of the part. The Visual Basic code which downloads instructions to the PMAC can be found in the subroutine DNLDFILE in the file MAIN.BAS in the appendix.

Referring now to FIG. 7B, it was noted above that in step 358 the Visual Basic program adds the cutter radius offset to the desired part outline to arrive at the path of the grinding wheel. The code which performs this specific step can be found in the subroutine OFFSETFILE in the file MAIN.BAS in the appendix. The operations of this code are charted in FIG. 7B and best understood by reference to the diagrams in FIGS. 9A–9D.

It should be understood that the G-code input file defines the part outline as a sequence of straight line segments and circular arcs. Each straight line segment is identified by the starting and ending points of the segment. Each arc is defined by a starting point, ending point, an X/Y offset from the starting point to the center of the arc, and an indication of the direction of the arc (clockwise or counterclockwise). This information is encoded into the G-code file in accordance with the standard G-code format referenced above. The OFFSETFILE subroutine operates upon the G-code input file on a segment-by-segment basis, and generates a new, offset series of segments which are also stored in G-code format.

Thus, the OFFSETFILE subroutine begins by selecting the G-code entry of the first segment of the part outline (step 400). Then, the subroutine enters a loop including steps 402 through 412, which steps are repeated for each segment in the part outline to produce a corresponding offset segment of the path of the grinding wheel.

Now referring to FIGS. 9A–9D, to create an offset segment, OFFSETFILE begins from the point of intersection $X_i$,$Y_i$ of the selected and subsequent segments of the part outline, where the preceding segment begins at a preceding point $X_{i-1}$,$Y_{i-1}$ and the subsequent segment ends at a subsequent point $X_{i+1}$,$Y_{i+1}$. The selected and subsequent segments may be either an arc or straight line. Where the preceding segment is an arc, the radius of the arc is defined by reference to an offset $I_i$,$J_i$ between the center and the point $X_{i-1}$,$Y_{i-1}$, and where the subsequent segment is an arc, the radius of the arc is defined by reference to an offset $I_{i+1}$,$J_{i+1}$ between the center and the point $X_i$, $Y_i$.

There are four possible combinations of adjoining segments, diagrammed separately in FIGS. 9A–9D for reference. These four combinations are handled in a similar fashion (as described below), albeit by separate code, in OFFSETFILE. In each case, in step 402, OFFSETFILE computes the angle (direction) of the selected and subsequent segments, represented by lines 420 and 421 in each of FIGS. 9A through 9D. In this step, the angle (direction) of an arc is the angle (direction) tangential to the arc at the point of intersection $X_i$,$Y_i$ between the arc segment and the adjacent segment.

Next, in step 404, OFFSETFILE computes the angle (equal to 2θ), between the selected and subsequent segments, and locates a line 422, which equally bisects this angle. This line is then used to locate the position P at which the grinding wheel should cease grinding the preceding segment of the part outline and begin grinding the subsequent segment of the part outline. To finish locating point P, in step 406 OFFSETFILE locates a point along the bisecting line 422 which a distance R/sinθ away from (in the direction away from the center of the part) the intersection $X_i$,$Y_i$ between the two adjacent segments. This is the point at which the grinding wheel should cease grinding the preceding segment and begin grinding the subsequent segment. Accordingly, in step 408 the coordinates of point P are stored in the offset G-code file. (If any X or Y part offsets have been requested by the user using the shift part screen (FIG. 8F), these are added to the X and Y coordinates of point P before point P is stored in the offset G-code file.)

If the subsequent segment is an arc segment, the grinding wheel must follow an arc to grind the subsequent segment. The center of the arc followed by the grinding wheel should be the same as the center of the arc on the part. However, the radius of the arc followed by the grinding wheel is greater or less than that of the arc on the part, due to the radius R of the grinding wheel. Therefore, in step 408, if the subsequent segment is an arc, OFFSETFILE stores in the offset G-code file, the X and Y offset between the point P and the center 424 of the arc to be ground on the part, thus causing the grinding wheel to create an arc about the same center to form the part.

After completing the computations described above, in step 410 OFFSETFILE determines whether there are additional segments (G-code entries) in the outline of the part, and if so, in step 412 selects the next segment and returns to step 402. After all segments in the original part outline have been analyzed, OFFSETFILE is completed and processing continues to subsequent steps.

Although the drawings in FIG. 9 show, for illustrative purposes, sharp corners between part outline segments, it will be understood that in normal circumstances the part outline is defined such that there are no such corners. That is, direction changes in the part outline are formed by curves rather than sharp breaks between straight lines as shown in FIG. 9A. Furthermore, junctions between curves and adjoining segments are typically arranged such that there is no sharp break, i.e., so that the tangent lines 400 and 401 illustrated in FIGS. 9B, 9C and 9D are collinear.

While the invention has been described to reference to specific embodiments, it is not intended that the invention be limited to such specifics. Various exchanges and modifications may occur to persons skilled in the art which are within the scope of the invention as defined in the appended claims.

What is claimed is:

1. A method of grinding the edge of a sheet of glass with a stationary multi-wheel grinder by releasably retaining a sheet of glass and moving said sheet of glass through three axes, depending on the size and shape of said glass sheet by the steps of:

locating a glass sheet, having an edge to be ground, on a support;

releasably retaining the glass sheet at a preselected location, corresponding to an axis of rotation, on said sheet;

lifting the glass sheet from the support to a preselected height corresponding to a preselected grinding wheel of the multi-wheel grinder;

grinding the edge of the sheet by simultaneously rotating and translating the glass sheet to maintain contact with the preselected grinding wheel of the multi-wheel grinder.

2. The method of claim 1 further comprising the step of: entering the profile of the glass into a microprocessor and then controlling with the microprocessor the lifting, translating and rotating steps.

3. The method of claim 1 wherein the step of releasably retaining the sheet of glass comprises locating the sheet of glass prior to retaining the sheet of glass, such that sheet of glass is releasably retained at a preselected location.

* * * * *